US007877839B2

(12) United States Patent
Phelan et al.

(10) Patent No.: US 7,877,839 B2
(45) Date of Patent: Feb. 1, 2011

(54) WET AND/OR DRY VACUUM WITH FLOOR COLLECTOR

(75) Inventors: Katherine E. Phelan, Towson, MD (US); Gregg L. Sheddy, Shrewsbury, PA (US); Paul S. White, Towson, MD (US); Michael P. Kunz, Hampstead, MD (US); Stuart J. Wright, Timonium, MD (US); Christopher J. Murray, Baltimore, MD (US); Trevor T. Bludis, Parkville, MD (US); Alfred H. Judge, Prescott, AZ (US)

(73) Assignee: Black & Decker Inc., Newark, DE (US)

( * ) Notice: Subject to any disclaimer, the term of this patent is extended or adjusted under 35 U.S.C. 154(b) by 726 days.

(21) Appl. No.: 11/870,986

(22) Filed: Oct. 11, 2007 (Under 37 CFR 1.47)

(65) Prior Publication Data

US 2008/0115317 A1 May 22, 2008

Related U.S. Application Data

(60) Provisional application No. 60/859,946, filed on Nov. 20, 2006.

(51) Int. Cl.
*A47L 9/00* (2006.01)

(52) U.S. Cl. ..... 15/354; 15/355; 15/415.1

(58) Field of Classification Search ..... 15/321, 15/322, 354–361, 410, 411, 415.1; *A47L 9/00, A47L 9/10*

See application file for complete search history.

(56) References Cited

U.S. PATENT DOCUMENTS

| | | | |
|---|---|---|---|
| 3,591,888 | A | 7/1971 | Takeda et al. |
| 3,708,962 | A | 1/1973 | Deguchi et al. |
| 4,258,451 | A | 3/1981 | Sommerfeld |
| 4,328,014 | A | 5/1982 | Burgoon et al. |
| 4,345,353 | A | 8/1982 | Sommerfeld |
| 4,360,947 | A | 11/1982 | DeCosa et al. |
| 4,704,144 | A | 11/1987 | LeBlanc et al. |
| 4,787,923 | A | 11/1988 | Fleigle et al. |

(Continued)

FOREIGN PATENT DOCUMENTS

| | | |
|---|---|---|
| DE | 4138223 | 2/1993 |

(Continued)

*Primary Examiner*—David A Redding
(74) *Attorney, Agent, or Firm*—Harness, Dickey & Pierce, P.L.C.

(57) ABSTRACT

A vacuum can include a housing having an inlet adapted to receive debris being vacuumed. A mounting bar can be fixedly coupled to the housing. A floor collector assembly can be rotatably disposed about a first axis defined by the mounting bar. The floor collector assembly can include a first debris-passing member coupled to the mounting bar, a second debris-passing member rotatably coupled to the first debris-passing member and a third debris-passing member removably coupled to the second debris-passing member. The first debris-passing member can define an opening. The floor collector assembly can be operable in a plurality of modes. In a first mode, the opening can be substantially perpendicular relative to a vacuumed surface. In a second mode, the second debris-passing member can be rotated relative to the first debris-passing member about a second axis such that the opening is at an acute angle relative to the vacuumed surface.

23 Claims, 19 Drawing Sheets

U.S. PATENT DOCUMENTS

| | | | |
|---|---|---|---|
| 4,833,752 | A | 5/1989 | Merrick |
| 5,013,333 | A | 5/1991 | Beaufoy et al. |
| 5,437,078 | A | 8/1995 | Courcelles et al. |
| 5,564,161 | A | 10/1996 | Glatz et al. |
| 5,953,788 | A | 9/1999 | Douglas |
| 5,983,442 | A | 11/1999 | Louis et al. |
| 6,671,924 | B1 | 1/2004 | Rood |
| 6,839,934 | B2 | 1/2005 | Houghton et al. |
| 6,895,632 | B2 | 5/2005 | Murray |
| 7,053,578 | B2 | 5/2006 | Diehl et al. |
| 7,055,210 | B2 | 6/2006 | Keppler et al. |
| 7,096,532 | B2 | 8/2006 | Rood |
| 7,171,719 | B1 | 2/2007 | Harrelson |
| 2002/0108209 | A1 | 8/2002 | Peterson |
| 2004/0045123 | A1 | 3/2004 | Engel et al. |
| 2006/0053582 | A1 | 3/2006 | Engel et al. |

FOREIGN PATENT DOCUMENTS

| | | |
|---|---|---|
| DE | 4332405 | 3/1995 |
| DE | 20106784 U | 7/2001 |
| DE | 202005006188 | 9/2005 |
| EP | 1110496 | 6/2001 |
| EP | 1290971 | 3/2003 |
| EP | 1776912 | 4/2007 |
| EP | 1955637 | 8/2008 |
| GB | 1107174 | 3/1968 |
| GB | 2398735 | 9/2004 |
| JP | 03146109 | 6/1991 |
| JP | 10309423 | 11/1998 |
| JP | 2002095615 | 4/2002 |
| JP | 2004121621 | 4/2004 |
| JP | 2005061166 | 3/2005 |
| JP | 2007319352 | 12/2007 |
| WO | 9218045 | 10/1992 |
| WO | WO-2004/022855 | 3/2004 |

WET AND/OR DRY VACUUM WITH FLOOR COLLECTOR

CROSS-REFERENCE TO RELATED APPLICATIONS

This application claims priority to U.S. Patent Application No. 60/859,946, filed on Nov. 20, 2006. The disclosure of the above application is incorporated herein by reference.

FIELD

The present disclosure relates to vacuums and more particularly to a wet/dry vacuum having multiple operating modes.

BACKGROUND

Wet/dry vacuums may be used to collect solid materials such as dirt, debris etc., as well as liquids, such as water etc. In some examples, a hose may be connected on a first end to an inlet port on a collection tub. A motor may be disposed within or about the vacuum that is operable to drive an impeller. Rotation of the impeller may create a vacuum pressure to siphon or otherwise urge the solid and/or liquid material through the hose and into the collection tub. In some examples, the hose may be connected at an opposite end to a hand held tube or accessory. During use, an operator may manually move the hand held tube or accessory onto or near the solid and/or liquid to be vacuumed.

SUMMARY

A vacuum can include a housing having an inlet adapted to receive debris being vacuumed. A mounting bar can be fixedly coupled to the housing. A floor collector assembly can be rotatably disposed about a first axis defined by the mounting bar. The floor collector assembly can include a first debris-passing member coupled to the mounting bar, a second debris-passing member rotatably coupled to the first debris-passing member and a third debris-passing member removably coupled to the second debris-passing member. The first debris-passing member can define an opening. The floor collector assembly can be operable in a plurality of modes. The modes can include a first mode, a second mode and a third mode. In the first mode, the opening can be substantially perpendicular relative to a vacuumed surface. In the second mode, the second debris-passing member can be rotated relative to the first debris-passing member about a second axis such that the opening is at an acute angle relative to the vacuumed surface. In the third mode, the third debris-passing member is coupled to the second debris-passing member wherein a passage defined through the third debris-passing member is substantially parallel to the vacuumed surface.

According to other features, the first axis can intersect the second axis. One of the first or second debris-passing members can define a collar. The other of the first or second debris-passing members can define a bore. The collar can rotate within the bore about the second axis during rotation of the second debris-passing member relative to the first debris-passing member.

According to still other features, one of the first or second debris-passing members can define a hub. The other of the first or second debris-passing member has a pair of fingers that define a notch. The hub can positively nest in the notch in a first position at any of the operating modes. The hub can ramp out of the notch over one of the fingers upon sufficient force during movement of the second debris-passing member out of the first position. The first debris-passing member can define opposing clam-shell portions that cooperate to form a first and a second pair of opposing planar sides. The second debris-passing member can define a back surface and a first pair of opposing surfaces. One surface of the first pair of opposing surfaces can be larger than the corresponding opposing surface of the first pair such that the opening defines an acute angle relative to the back surface. The back surface can oppose the first debris-passing member.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
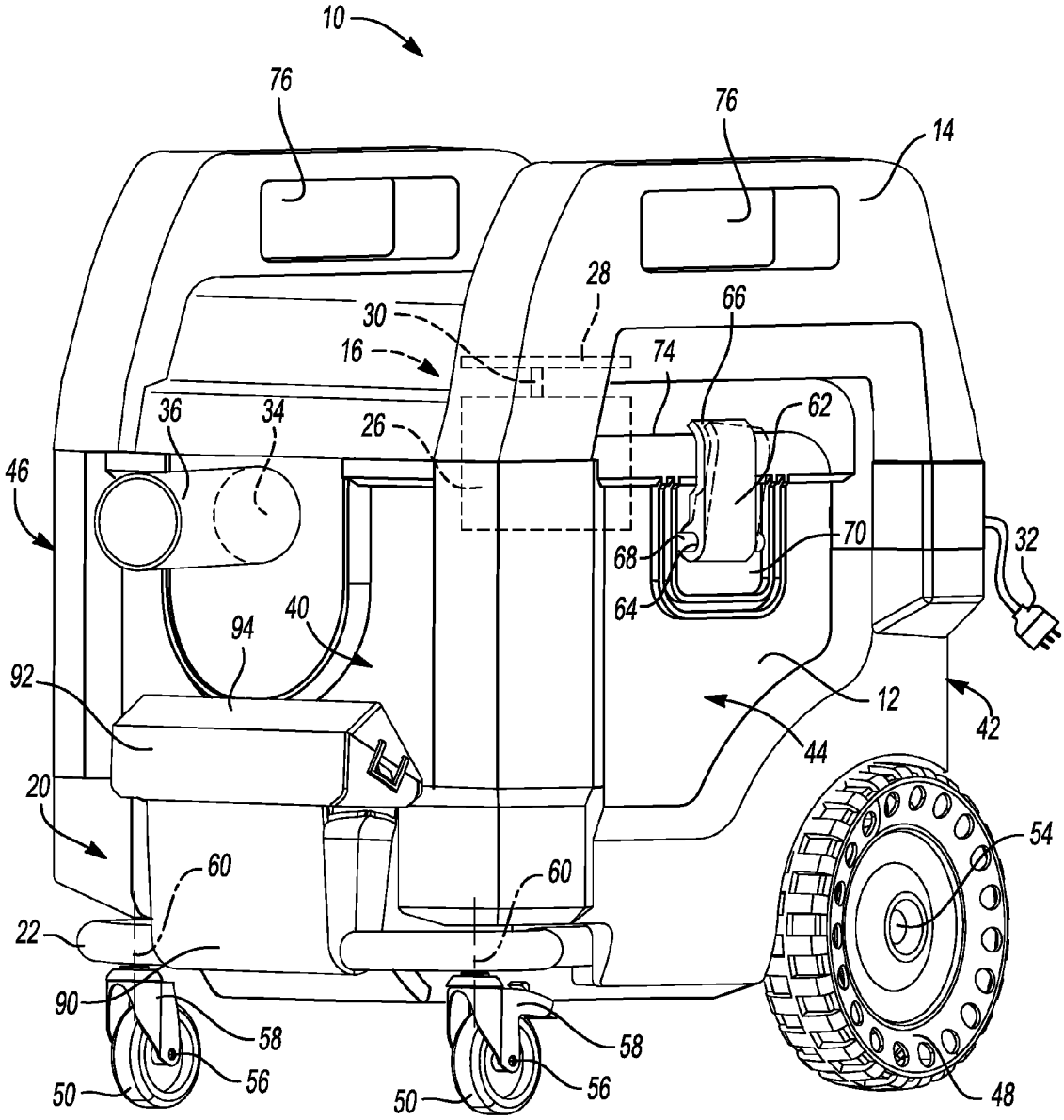
FIG. 1 is a front perspective view of an exemplary wet/dry vacuum constructed in accordance with the teachings of the present disclosure.

With initial reference to FIG. 1, an exemplary vacuum constructed in accordance with the present teachings is shown and generally identified at reference numeral 10. The vacuum 10 can generally include a housing 12, a cover 14, a motor assembly 16, and a floor collector assembly 20. The floor collector assembly 20 can be rotatably coupled to a mounting bar 22 extending from the housing 12. The motor assembly 16 can be disposed within the housing 12 and/or the cover 14. The motor assembly 16 can include a motor 26 that drives an impeller (fan) 28 through an output shaft 30. The motor 26 can be powered by an AC source by way of an electrical plug 32. An on/off switch (not shown) may be provided on the housing 12 or cover 14. An inlet 34 can be defined on the housing 12. An intake port 36 can be integrally formed or otherwise coupled to the housing 12 at the inlet 34. During operation of the vacuum 10, rotation of the impeller 28 can cause suction within the housing 10 for ingesting debris and/or liquid through the inlet 34. Exhausted air may exit the housing 12 at an outlet port (not specifically shown).

The exemplary vacuum 10 can define a cube-like shape having opposing front and rear sides 40 and 42 connected between opposing connecting sides 44 and 46. A first and second pair of wheels, 48 and 50, respectively, may be coupled to the vacuum 10 for rolling the vacuum 10 across a floor. The first pair of wheels 48 (only one shown) may be fixed for rotation about an axle 54 that defines an axis generally parallel to the front and rear sides 40 and 42. The second pair of wheels 50 can be caster wheels that rotate about axles within respective carriers 58. The carriers 58 can be coupled to the mounting bar 22 for rotation about respective axes 60. Other wheel configurations may be employed.

A pair of latches 62 (only one shown) can be disposed on the opposing sides 44 and 46 of the vacuum 10. Description of the exposed latch 62 on the opposing side 44 will now be described while it is appreciated that the same latch configuration may be provided on the other opposing side 46. The latch 62 can generally define a mounting bore 64 on a first end and a curved retaining portion 66 on a second end. The latch 62 can be mounted about a shaft 68 extending in a pocket 70 defined on the opposing side 44. The latch 62 can rotate about the shaft 68 between a secured position (solid line, FIG. 1) wherein the curved retaining portion 66 captures a ledge 74 of the cover 14, and an unsecured position (phantom line, FIG. 1). In the unsecured position, the cover 14 can be lifted (i.e. in a direction upward as viewed in FIG. 1) away from the housing 12 for accessing the motor assembly 16 and/or emptying the vacuumed contents from the housing 12. The cover 14 can define a pair of handles 76 formed thereon. An operator can grasp the handles 76 to move the vacuum 10 as a whole or lift the cover 14 away from the housing 12.

With continued reference to FIG. 1 and additional reference to FIGS. 2 and 3, the mounting bar 22 and floor collection assembly 20 will be described in greater detail. The mounting bar 22 can define a tubular member having a linear central portion 80, a pair of linear end portions 82, and a pair of curved portions 84 that transition between the linear central portion 80 and the linear end portions 82. Apertures 86 can be formed through the mounting bar 22 for receiving fasteners (not shown) to couple to mounting bar 22 to the housing 12.

Figure 2:
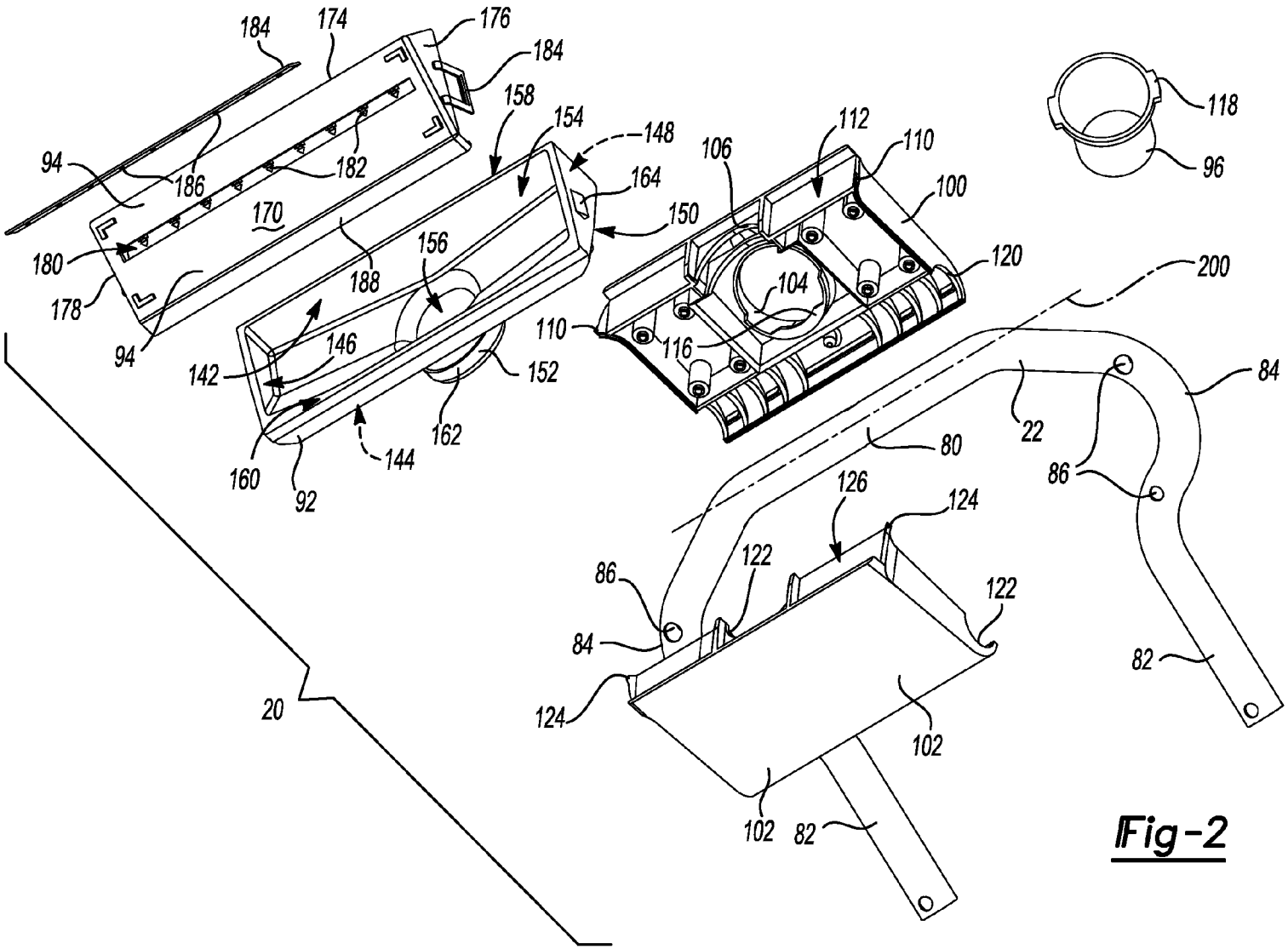
FIG. 2 is an exploded perspective view of a floor collector assembly and mounting bar of the wet/dry vacuum of FIG. 1.

The floor collection assembly 20 can include a connecting duct 90 (FIG. 1), a floor scoop 92, a squeegee adapter 94, and a hose cuff 96 (FIG. 2). The connecting duct 90 can be collectively defined by a first and a second clamshell portion 100 and 102 (FIG. 2), respectively. The first clamshell portion 100 can define a mounting sleeve 104 and a first semi-hemispherical wall portion 106. The mounting sleeve 104 can be adapted to receive the hose cuff 96. First fingers 110 can be formed on a forward face 112 of the first clamshell portion 100. A first annular lip 116 can be formed on the mounting sleeve 104 for cooperatively mating with a second annular lip 118 formed on the hose cuff 96. A first half-cylinder 120 can be defined on the first clamshell portion 100. A second semi-hemispherical wall portion 122 can be defined on the second clamshell portion 102. Second fingers 124 can be formed on a forward face 126 of the second clamshell portion 102.

Figure 3:
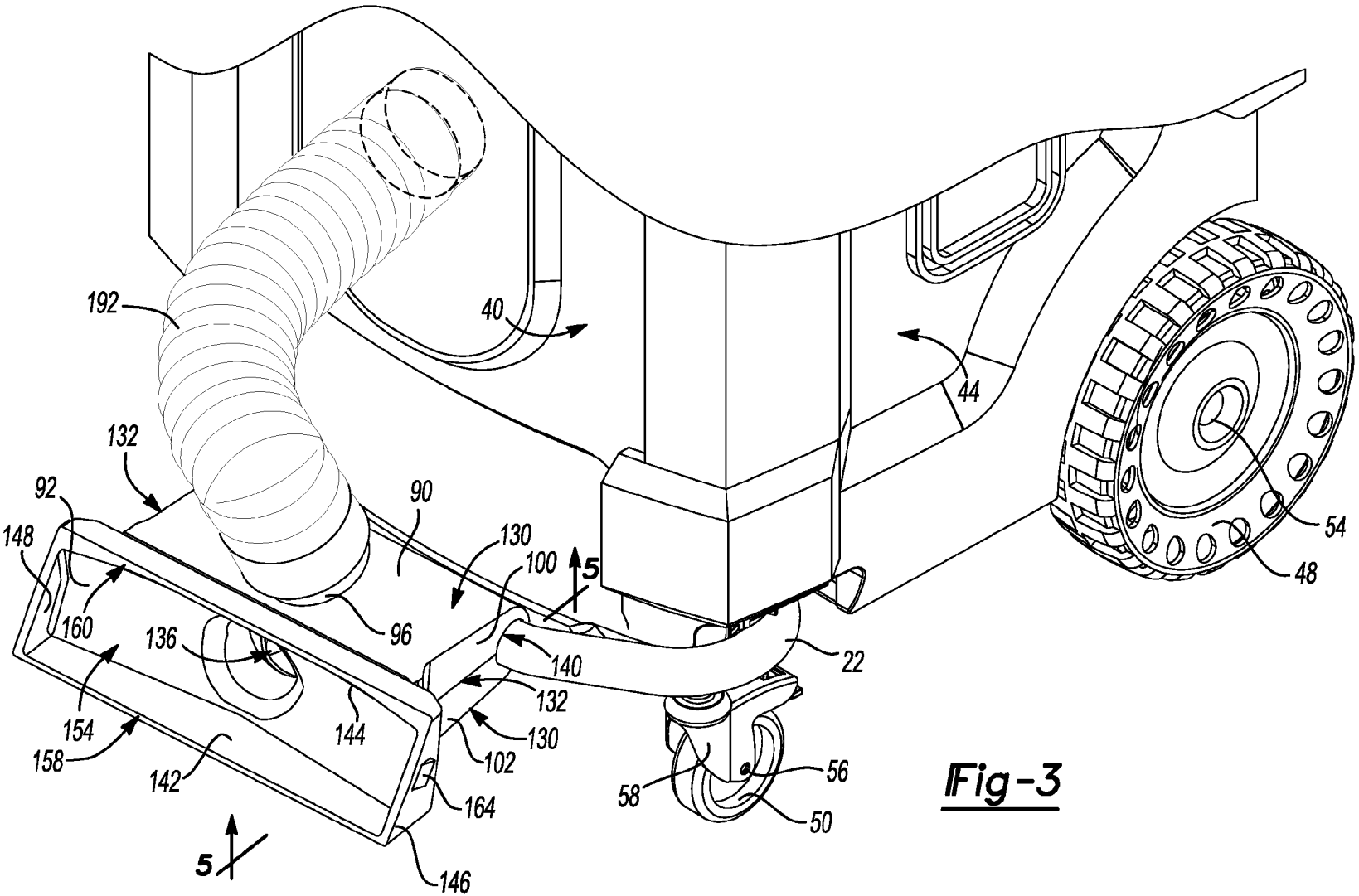
FIG. 3 is a front perspective view of a portion of the vacuum of FIG. 1 including a floor scoop and connecting duct shown in a first (or sweep) mode of operation.

The connecting duct 90 can generally define a first and a second pair of opposing sides 130 and 132, respectively in an assembled position (FIG. 3). A mounting bore 136 can be collectively defined by the first and second semi-hemispherical wall portions 106 and 122. The first and second half-cylinders 120 and 122 can cooperatively define a mounting cylinder 140 (FIG. 3) for accepting the central portion 80 of the mounting bar 22 in the assembled position. The connecting duct 90 can be formed of durable lightweight material such as plastic.

Returning now to FIG. 2, the floor scoop 92 can generally define a first pair of opposing surfaces 142 and 144, a second pair of opposing surfaces 146 and 148, a back surface 150, and a collar 152. An opening 154 is defined collectively by the opposing surfaces 142, 144, 146, and 148. The back surface 150 and the collar 152 can cooperate to define a chute 156. The first surface 142 of the first pair of opposing surfaces 142 and 144 can be larger than the second surface 144 of the first pair of opposing surfaces 142 and 144 such that the opening 154 can define an acute angle β (FIG. 4) relative to the back surface 150. The first surface 142 can define a first sweep edge 158. The second surface 144 can define a second sweep edge 160. The collar 152 can be generally cylindrical and extend from the back surface 150. An annular ring 162 can be integrally formed around the collar 152. A pair of tabs 164 can be formed on the second pair of opposing surfaces 146 and 148, respectively. The back surface 150 can define a pair of hubs 166 (best shown in FIG. 6). The floor scoop 92 can be formed of durable lightweight material such as plastic.

With continued reference to FIG. 2, the squeegee adapter 94 can define a bottom surface 170, a forward surface 172 and a pair of side surfaces 174 and 176. A longitudinal opening 180 can be formed through the bottom surface 170. A plurality of connecting pins 182 can be formed on the squeegee adapter 94 adjacent to the longitudinal opening 180. In one example, the connecting pins can define Christmas tree retainers although other configurations or arrangements are contemplated. A blade 184 can define a complementary plurality of passages 186 for accepting the connecting pins 182 in an installed position (see also FIG. 16). The blade 184 can define a linear body that substantially corresponds for accommodation by the longitudinal opening 180. A pair of ears 184 can be formed on the pair of side surfaces 176 and 178, respectively. A flap 188 can be formed along the bottom surface 170 of the squeegee adapter 94. The squeegee adapter 94 can be formed of a durable lightweight material such as plastic while the blade 184 can be formed of resilient material such as rubber.

With reference now to all FIGS., the vacuum 10 according to the present teachings is operable in a plurality of operating modes. More specifically, the floor collector assembly 20 can be manipulated into multiple shapes and orientations to accommodate a given task. The various modes can include a first or "sweep mode" (FIGS. 3-5), a second or "floor nozzle mode" (FIGS. 9-11), and a third or "squeegee mode" (FIGS. 13-16). The vacuum 10 can also operate in a fourth mode wherein a connecting hose 192 coupled between the intake port 36 and the hose cuff 96 of the floor collector assembly 20 is disconnected from the hose cuff 96 and used as a conventional vacuum hose. In the fourth mode, the floor collection assembly 20 can be rotated about the mounting bar 22 to a transportation position (FIG. 1).

Figure 4:
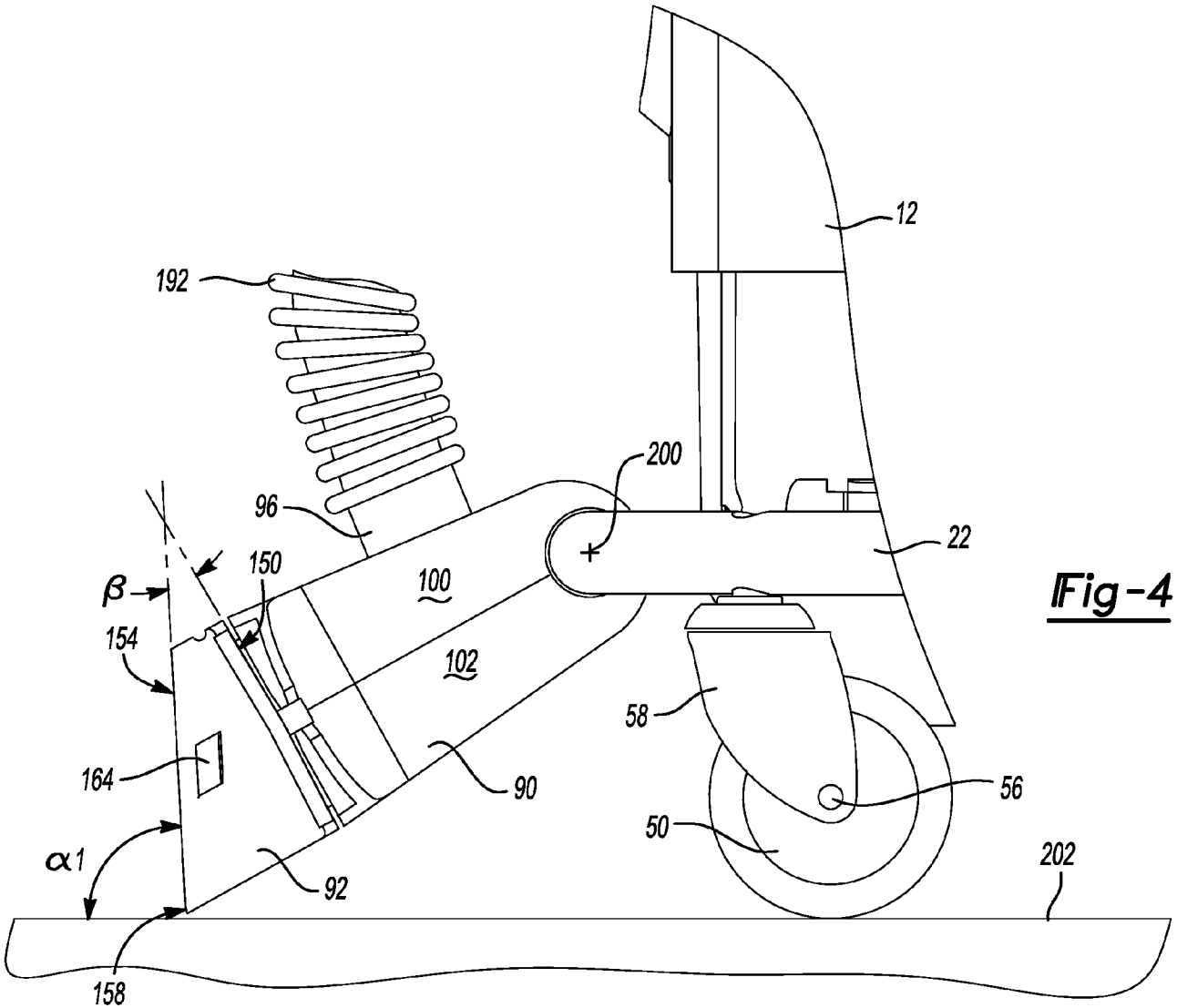
FIG. 4 is a side view of a portion of the vacuum shown in FIG. 3.
Figure 5:
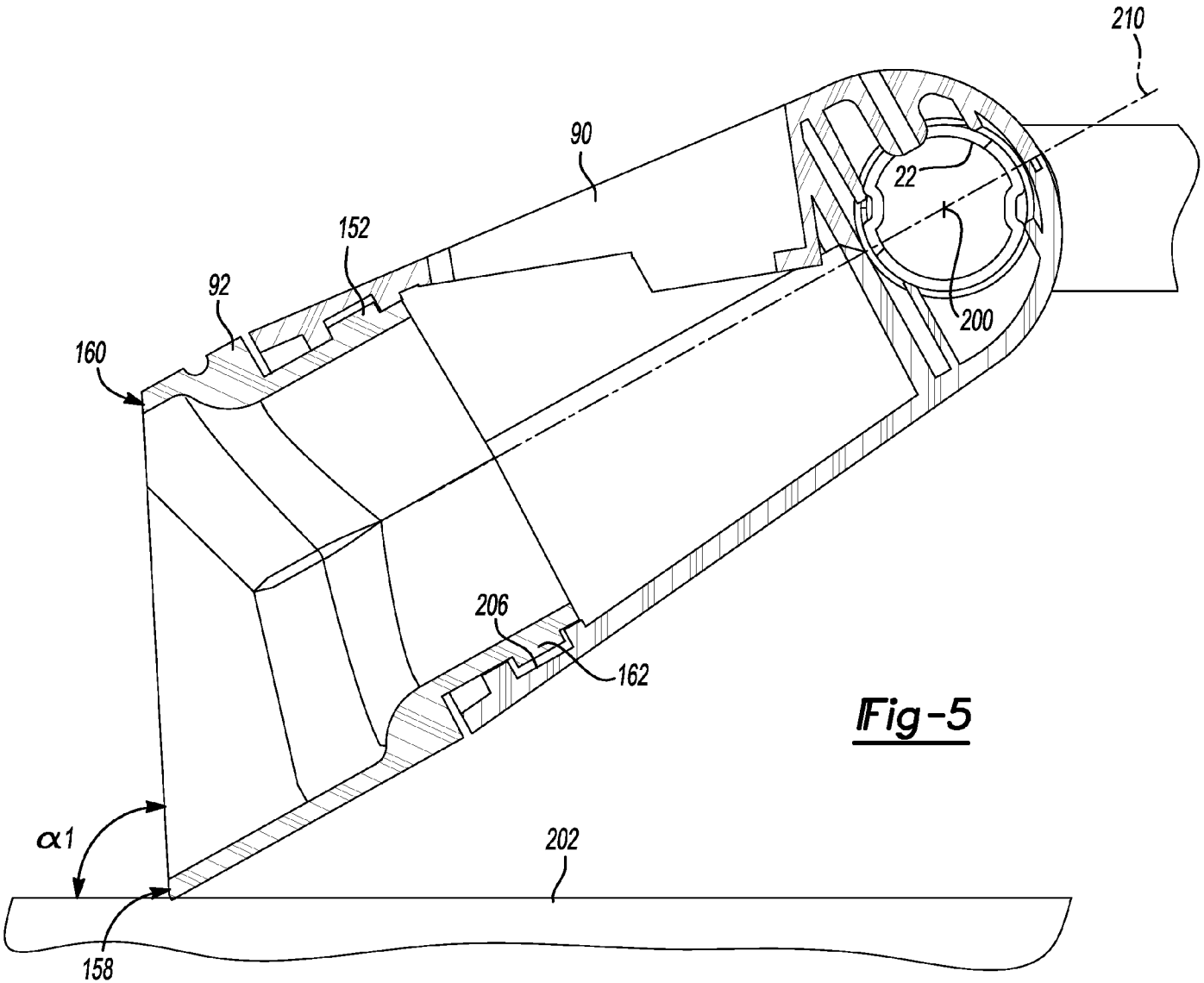
FIG. 5 is a sectional view of the floor scoop and connecting duct in the first mode taken along line 5-5 of FIG. 3.

With particular reference now to FIGS. 3-5, operation of the vacuum 10 in the "sweep mode" will be described in greater detail. In the "sweep mode", the connecting duct 90 is rotated about an axis 200 defined by the mounting bar 22 such that the first sweep edge 158 slides against or substantially adjacent to a vacuumed surface 202. The connecting hose 192 can be coupled between the intake port 36 and the hose cuff 96. In this position, the opening 154 of the floor scoop 92 can define an angle $\alpha 1$ relative to the vacuumed surface 202. The angle $\alpha 1$ can be substantially about 90 degrees. It is appreciated that this angle can be altered by rotating the connecting duct 90 about the mounting bar axis 200. The annular ring 162 (FIG. 5) of the floor scoop 92 can nest within an annular pocket 206 defined inboard of the first and second semi-hemispherical wall portions 106 on the connecting duct 90. In the "sweep mode," the floor scoop 92, the connecting duct 90 and the connecting hose 192 each act as sequential debris-passing ducts to direct the vacuumed material into the housing 12.

Figure 6:
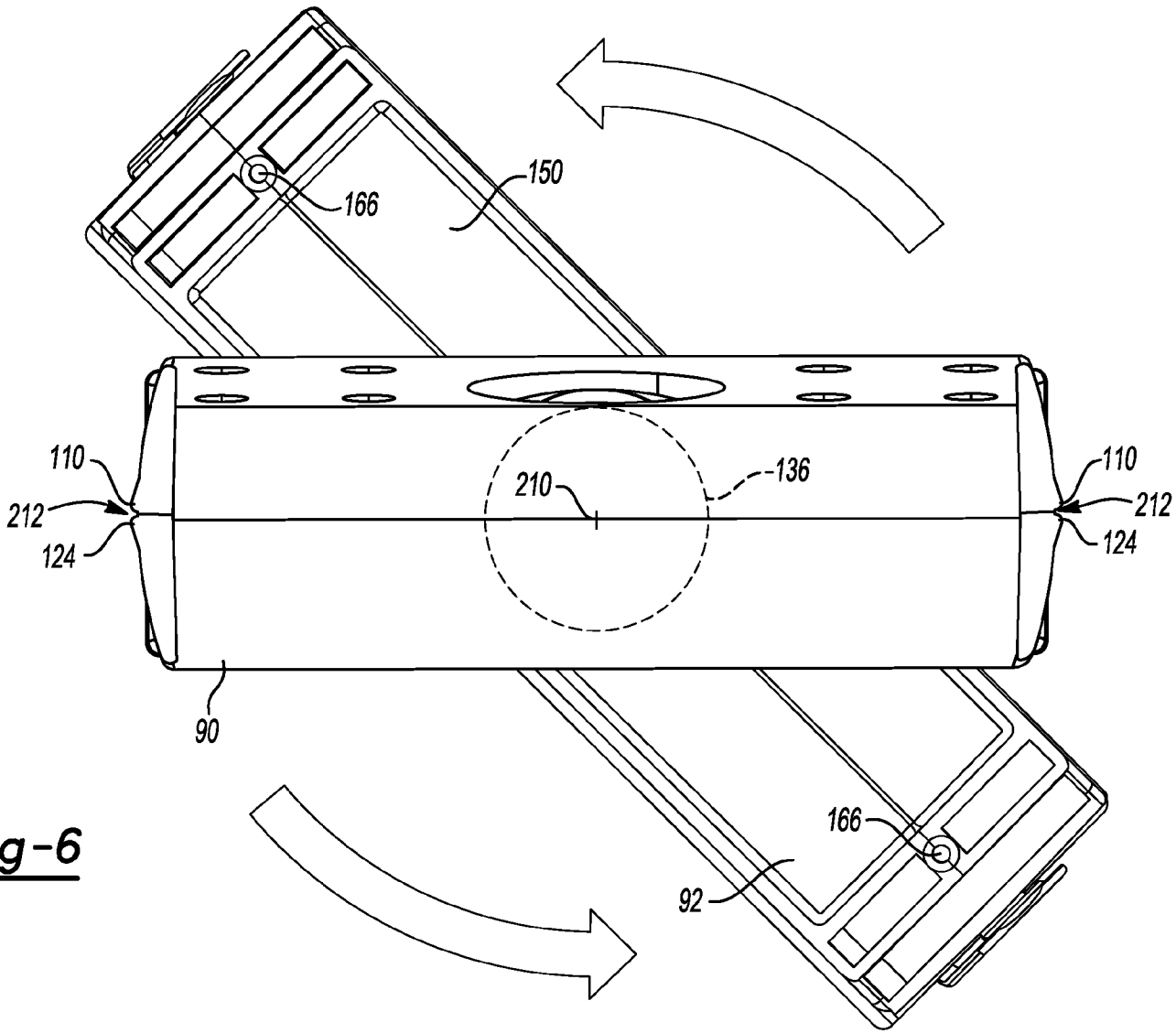
FIG. 6 is an action sequence illustrating rotation of the floor scoop relative to the connecting duct.
Figure 8:
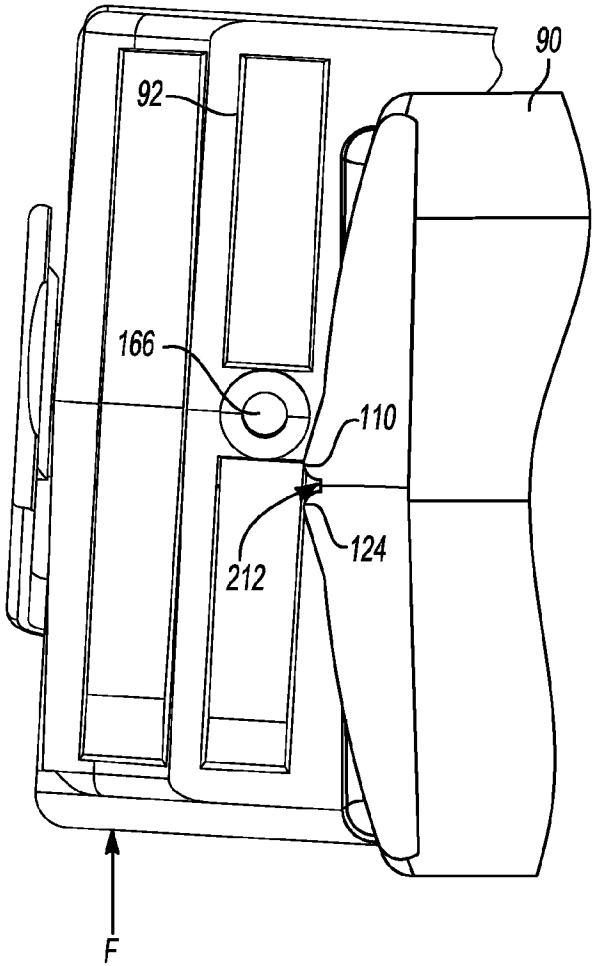
FIG. 8 is a detail view of the hub of the floor scoop in an unengaged position relative to cooperating fingers disposed on the connecting duct.
Figure 7:
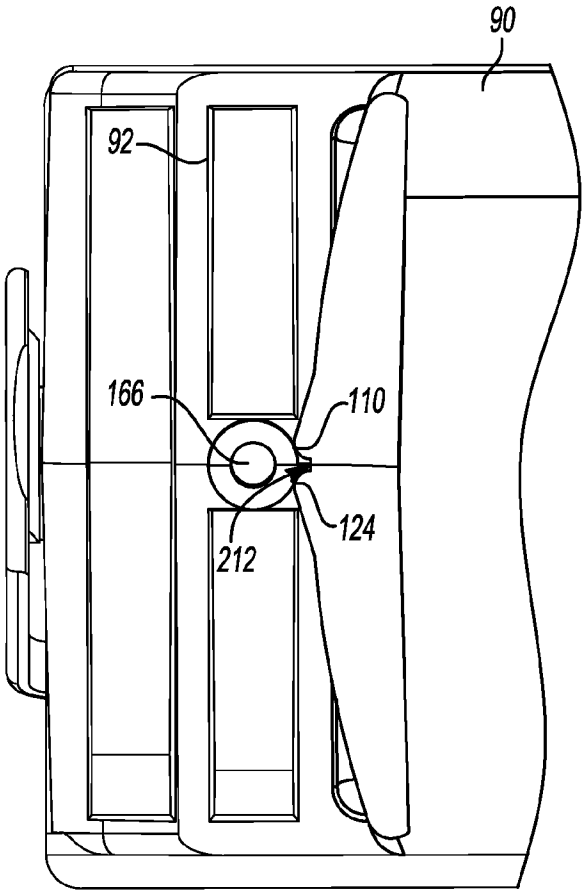
FIG. 7 is a detail view of a hub disposed on the floor scoop in a nested between cooperating fingers of the connecting duct in an engaged position.

With continued reference to FIG. 5 and additional reference to FIGS. 6-8, movement of the floor scoop 92 relative to the connecting duct 90 will be described. In general, the collar 152 (FIGS. 2 and 5) can selectively rotate about an axis 210 (FIG. 5) defined by the mounting bore 136 of the connecting duct 90. During rotation, the annular ring 162 of the floor scoop 92 can ride within the annular pocket 206 of the connecting duct 90 (FIG. 5). As shown in FIG. 7, while in one of the modes (i.e., sweep mode, floor nozzle mode etc.), the hubs 166 (only one shown) of the floor scoop 92 positively nest in a locked position within a notch 212 defined between the fingers 110 and 124 of the connecting duct 90. Upon enough rotational force F (FIG. 8) administered by a user onto the floor scoop 92, the hub 166 can ramp out of the notch 212 over one of the fingers 110 or 124 into an unlocked position (e.g., for free rotation of the floor scoop 92 about the axis 210).

Figure 9:
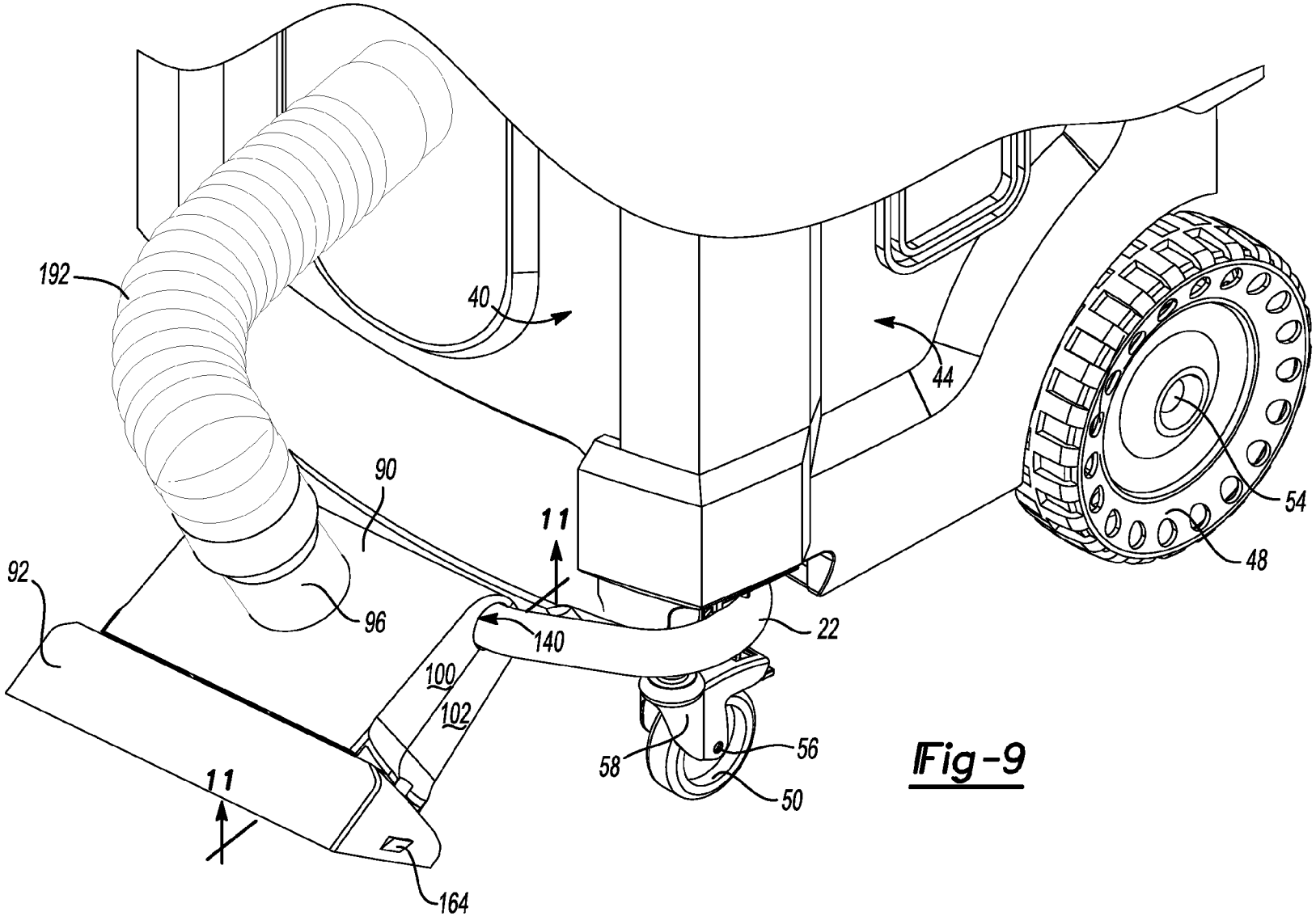
FIG. 9 is a front perspective view of a portion of the vacuum of FIG. 1 including a floor scoop and connecting duct shown in a second (or floor nozzle) mode of operation.
Figure 10:
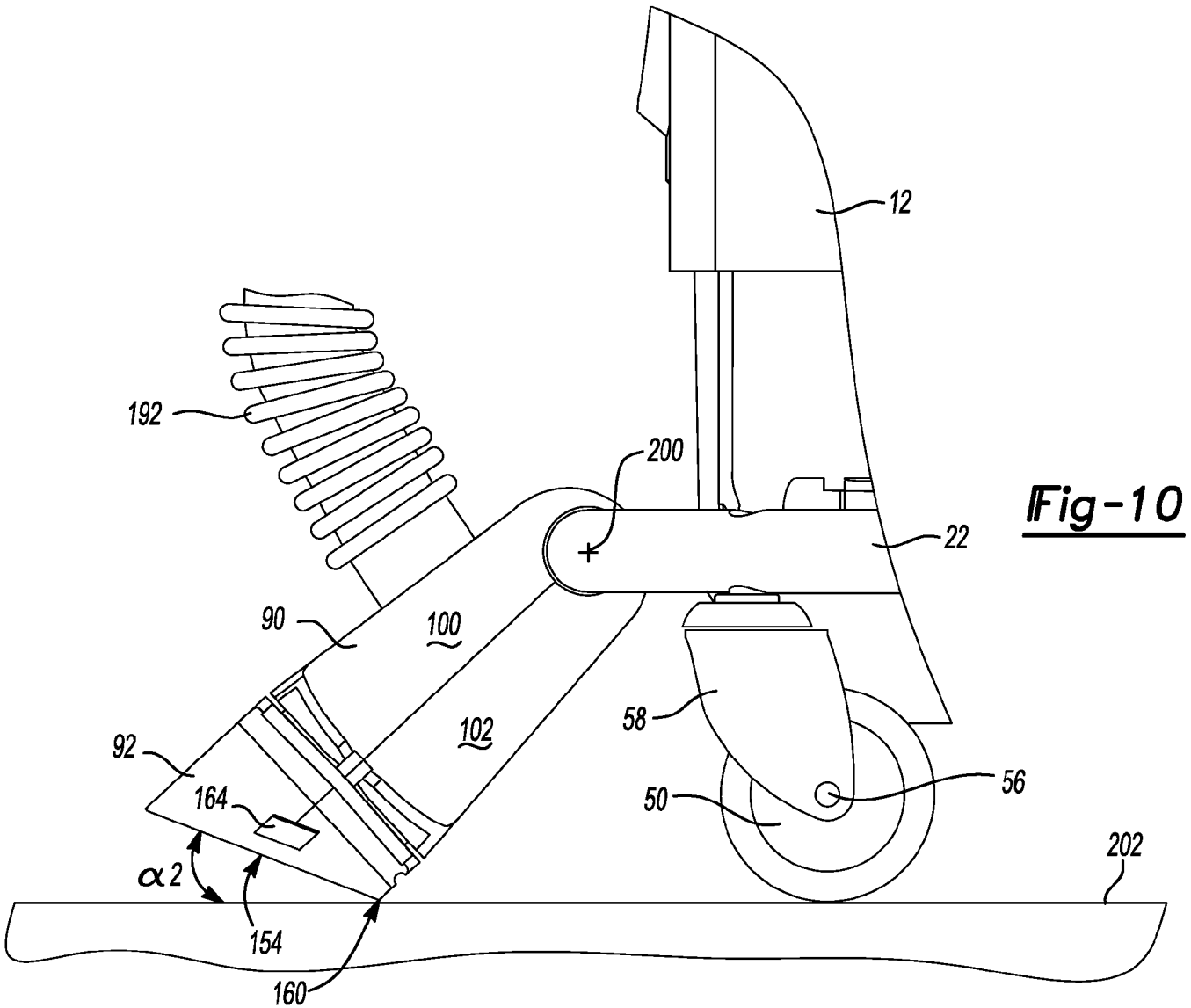
FIG. 10 is a side view of a portion of the vacuum shown in FIG. 9.
Figure 11:
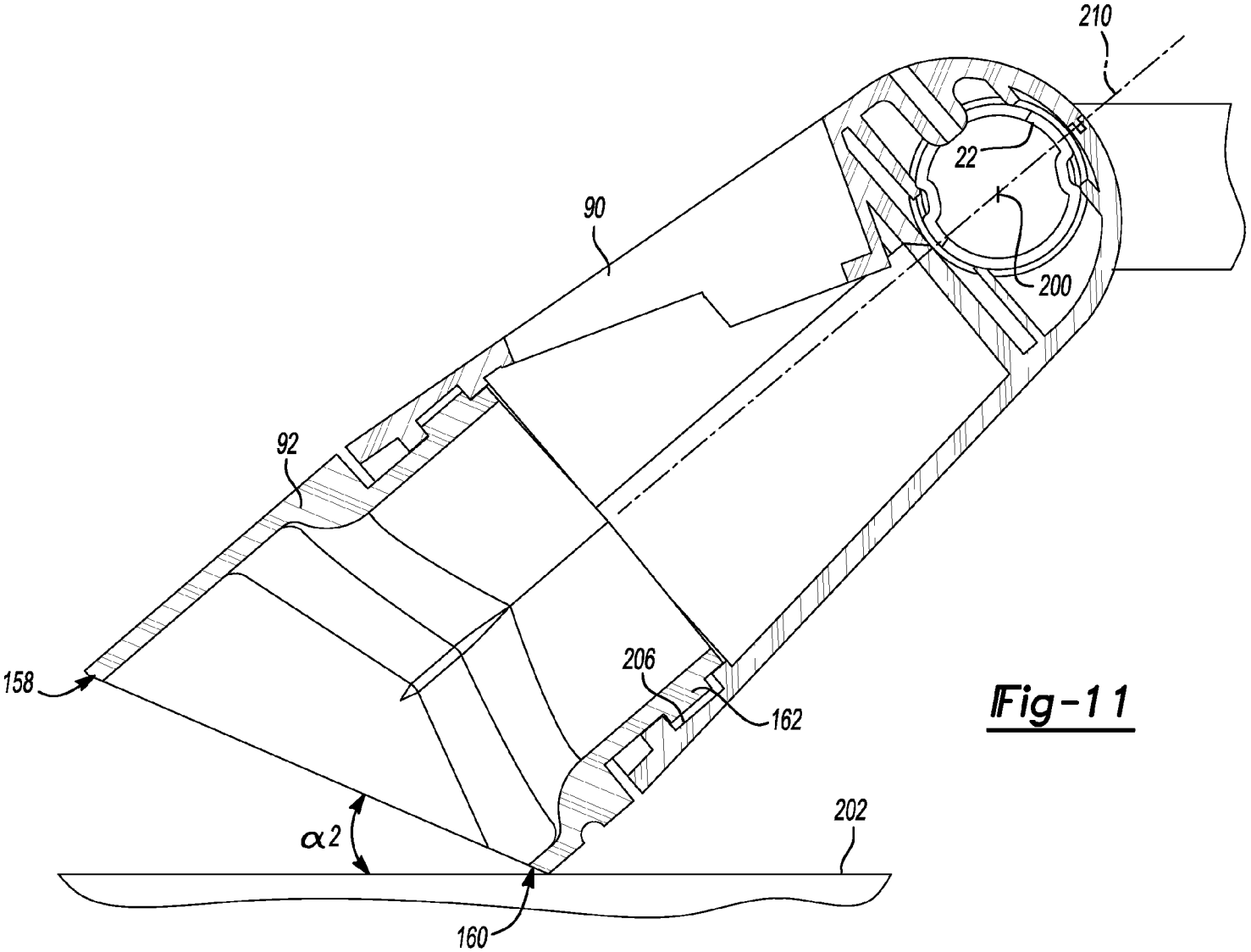
FIG. 11 is a sectional view of the floor scoop and connecting duct in the second mode taken along line 11-11 of FIG. 9.
Figure 12:
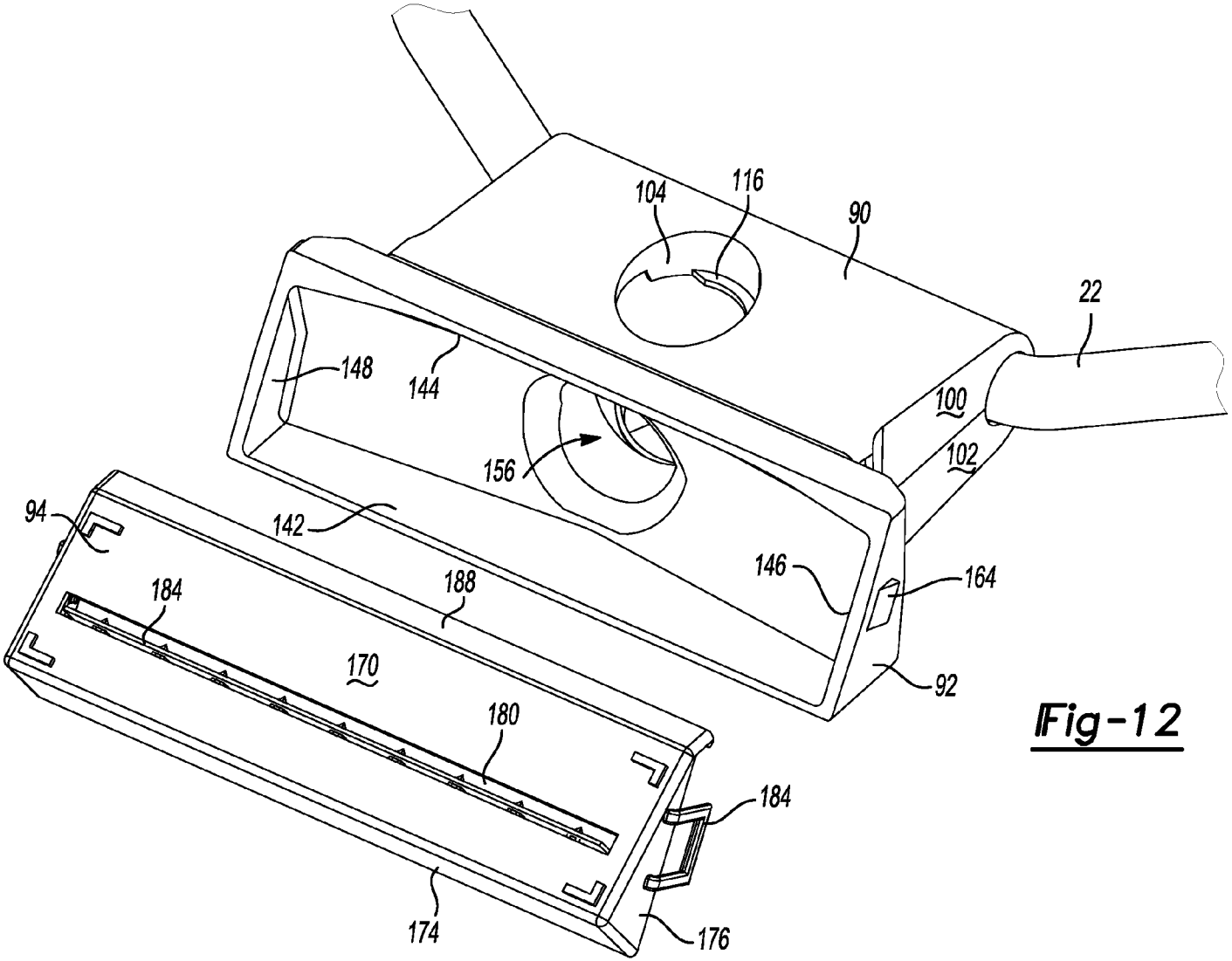
FIG. 12 is a front perspective view of the floor connecting assembly of the vacuum in FIG. 1 and illustrating a squeegee attachment offset from the floor scoop.

With particular reference now to FIGS. 9-11, operation of the vacuum in the "floor nozzle mode" will be described in greater detail. In the "floor nozzle mode", the connecting duct 90 is rotated about the mounting bar 22 (e.g., about the axis 200, FIG. 10) such that the second sweep edge 160 slides against or substantially adjacent a vacuumed surface 202. As can be appreciated from the preceding discussion, the floor scoop 92 can rotate 180 degrees about the axis 210 (FIG. 6) from the "sweep mode" position to the "floor nozzle mode", and vice-versa. The connecting hose 192 can be coupled between the intake port 36 (FIG. 1) and the hose cuff 96. In this position, the opening 154 of the floor scoop 92 can define an angle $\alpha 2$ (FIG. 10) relative to the vacuumed surface 202. The angle $\alpha 2$ can be an acute angle. In one example, the angle $\alpha 2$ can be approximately between 25 and 65 degrees. It is appreciated that this angle can be altered by rotating the connecting duct 90 about the mounting bar axis 200. In the "floor nozzle mode," the floor scoop 92, the connecting duct 90 and the connecting hose 192 each act as sequential debris-passing ducts to direct the vacuumed material into the housing 12.

Figure 13:
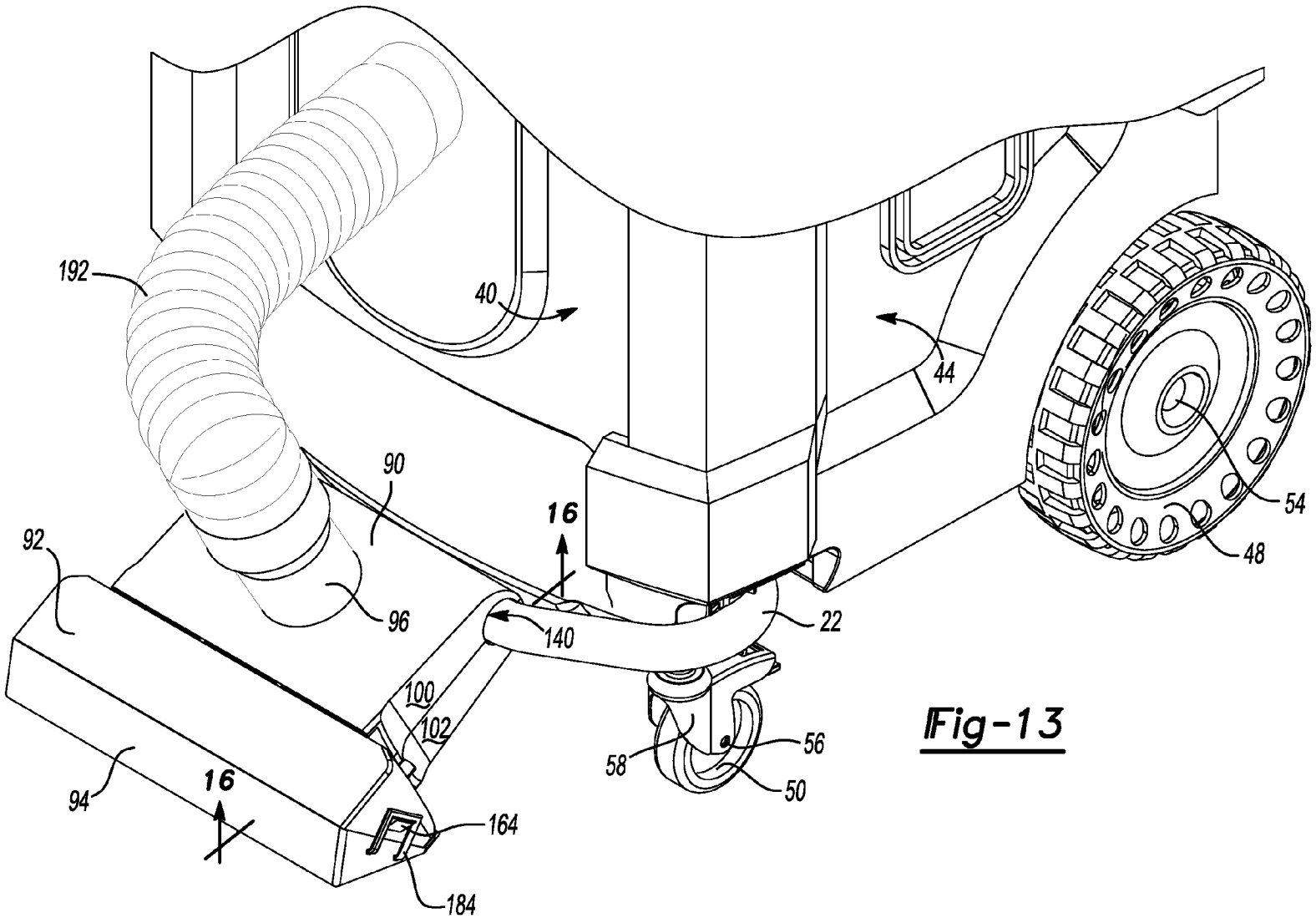
FIG. 13 is a front perspective view of a portion of the vacuum of FIG. 1 shown with the squeegee attachment connected to the floor scoop in a third (or squeegee) mode of operation.
Figure 14:
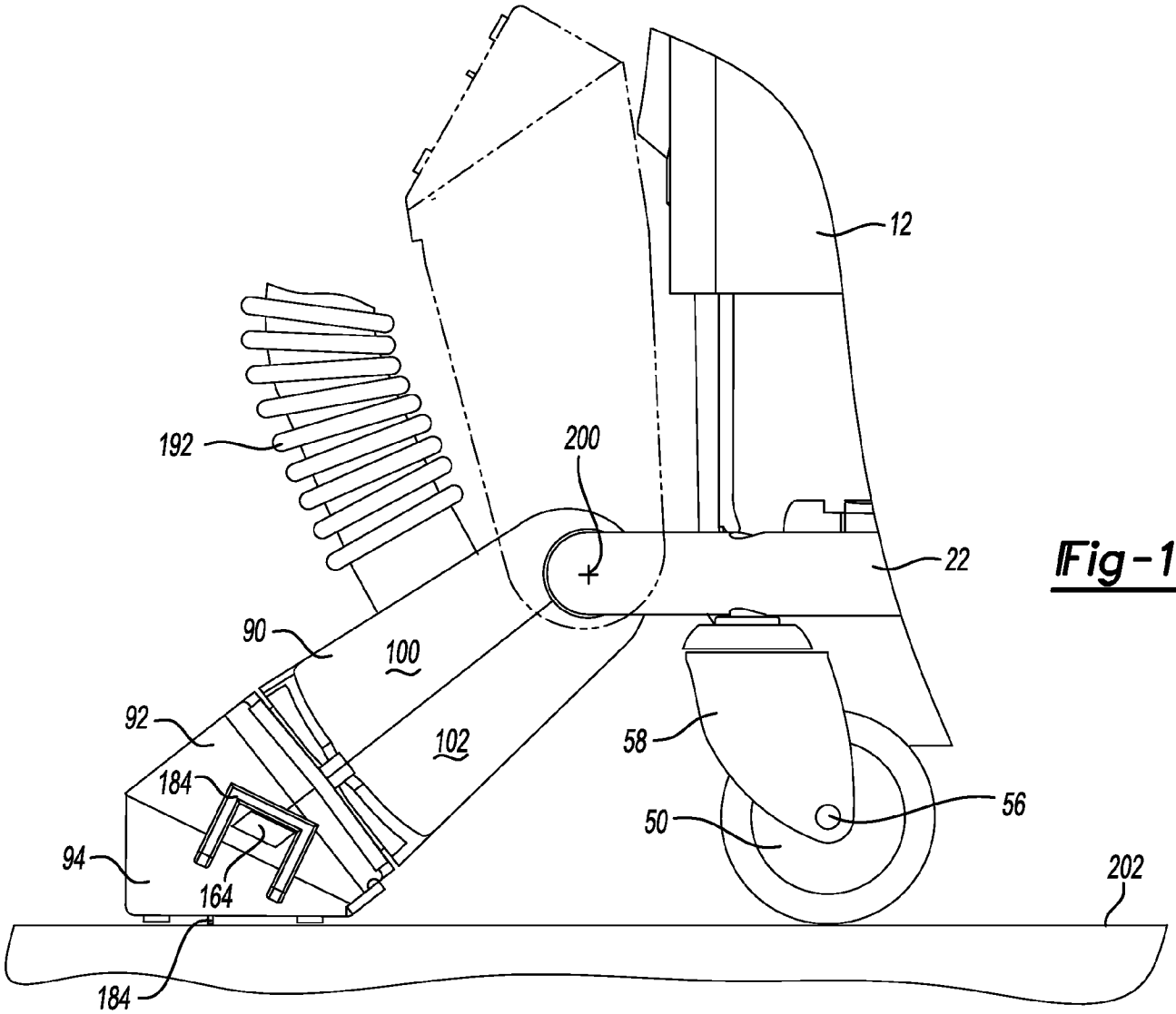
FIG. 14 is a side view of a portion of the vacuum shown in FIG. 13 (solid line) and also shown with the floor collector assembly rotated about an axis of the mounting bar in a storage position (phantom line)
Figure 15:
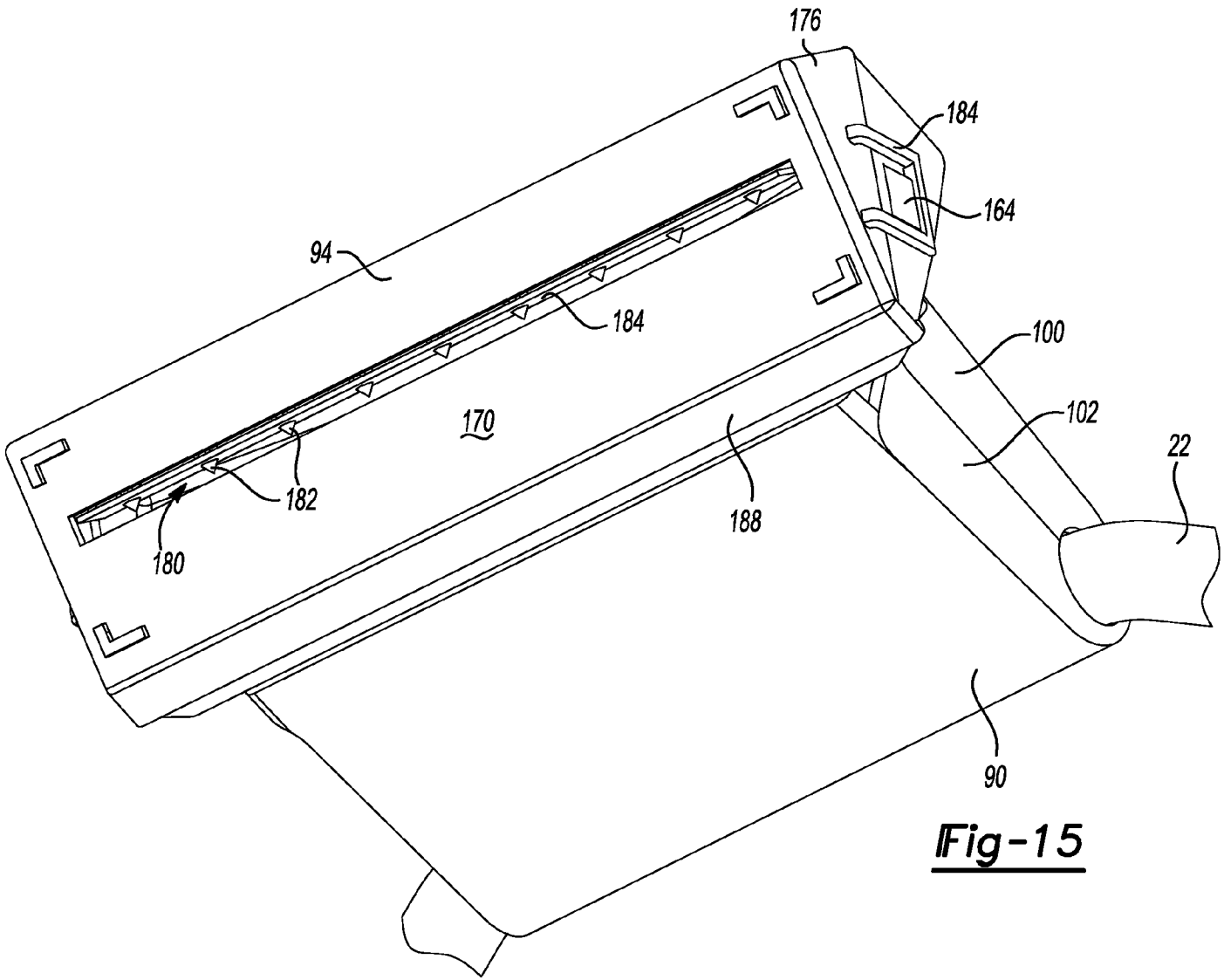
FIG. 15 is a bottom perspective view of the floor collector assembly with the squeegee attachment coupled to the floor scoop in the third mode.
Figure 16:
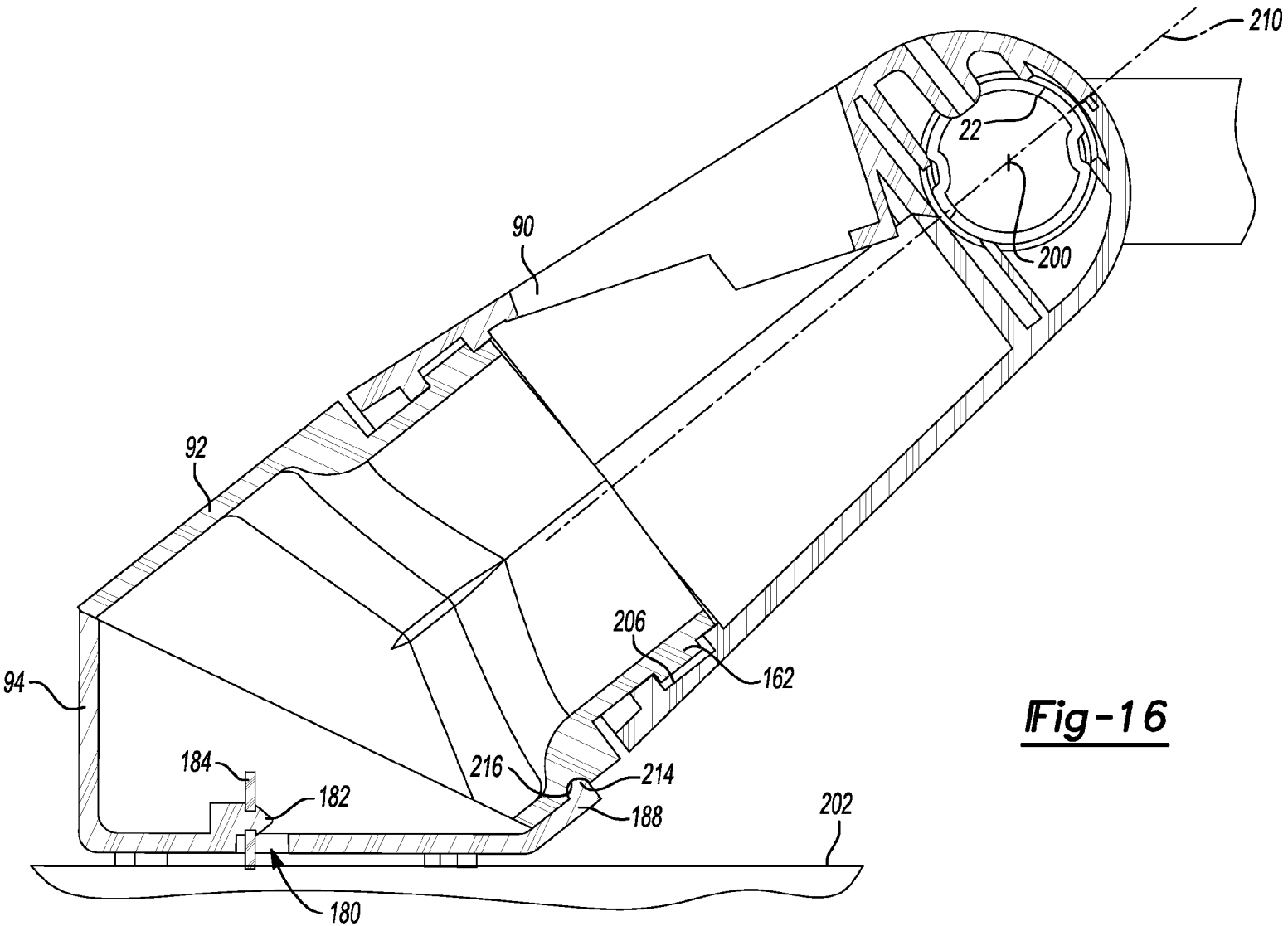
FIG. 16 is a sectional view of the floor collector assembly in the third mode taken along line 16-16 of FIG. 13.

With particular reference now to FIGS. 12-16, operation of the vacuum 10 in the "squeegee mode" will be described in greater detail. In the squeegee mode, the squeegee adapter 94 is coupled to the floor scoop 92. More specifically, the flap 188 of the squeegee adapter 94 can be located against the first wall 144 of the floor scoop 92. As best illustrated in FIG. 16, a locating ridge 214 defined on the flap 188 can nest within a groove 216 defined on the wall 144 of the floor scoop 92. The ears 184 of the squeegee attachment 94 can ramp over the respective tabs 164 of the floor scoop 92 until they reach a position beyond the ramps 164 (FIG. 13). In the squeegee mode, the bottom surface 170 can be substantially parallel to the vacuumed surface 202 (FIG. 14). Again, It is appreciated that this angle can be altered by rotating the connecting duct 90 about the mounting bar axis 200. The blade 184 can extend through the longitudinal passage 180 for slidably traversing along the vacuumed surface 202. As can be appreciated, the blade 184 can assist in directing liquid (and/or solid debris) to a position near the longitudinal passage 180 to be siphoned. In the "squeegee mode", the squeegee adapter 94, the floor scoop 92, the connecting duct 90 and the connecting hose 192 each act as sequential debris-passing ducts to direct the vacuumed material into the housing 12.

Figure 17:
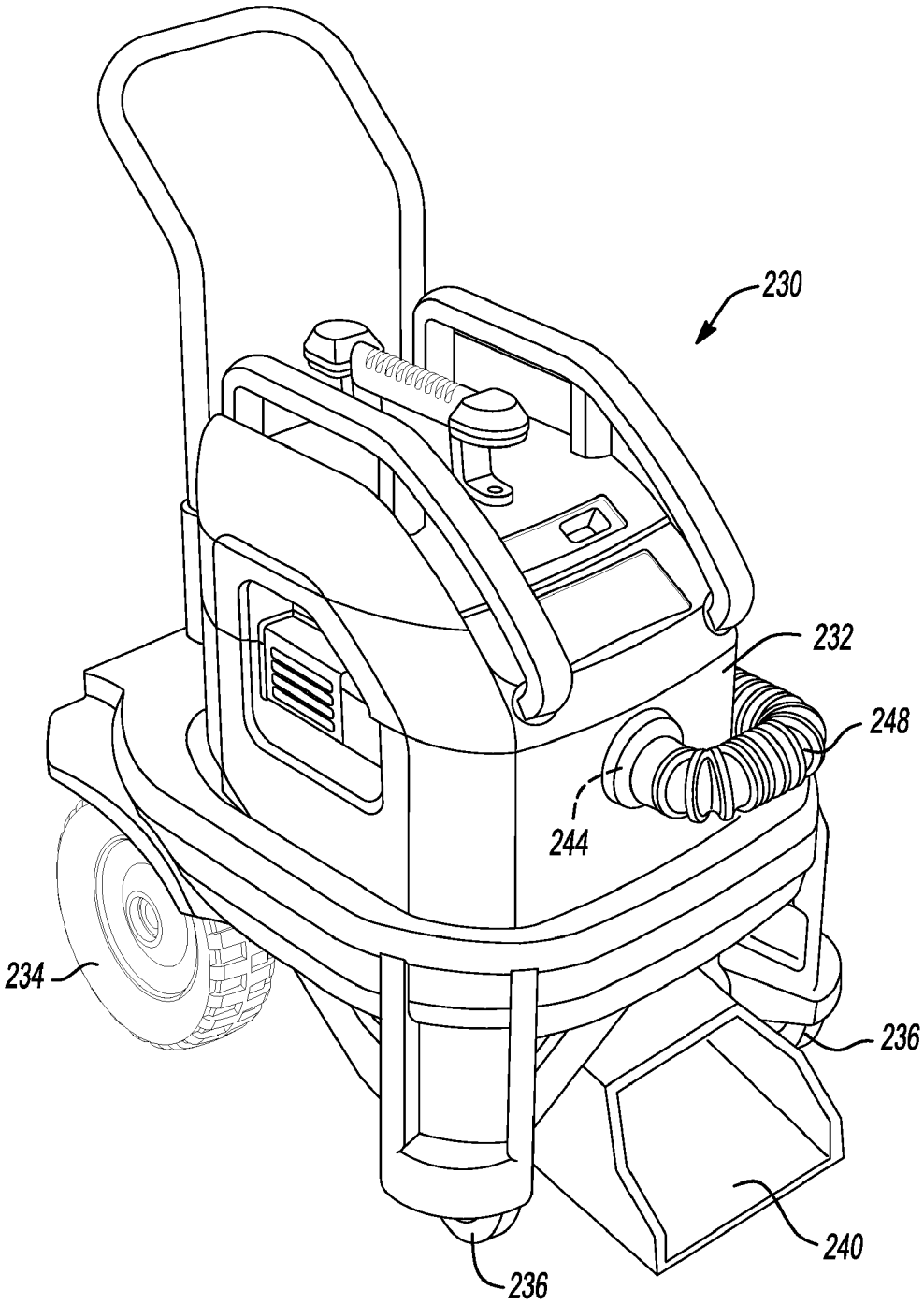
FIG. 17 is a front perspective view of an exemplary wet/dry vacuum constructed in accordance to additional features of the present disclosure.

With reference now to FIG. 17, a wet/dry vacuum according to additional features is shown and generally identified at reference numeral 230. The vacuum 230 can define a cube-like body 232. A first and second pair of wheels, 234 and 236, respectively, may be coupled to the vacuum 230 for rolling the vacuum 230 across a floor. The first pair of wheels 234 (only one shown) may be fixed for rotation about an axis. The second pair of wheels 236 can be caster wheels that rotate about axles within carriers, similar to described with wheels 50 (FIG. 1).

The wet/dry vacuum 230 can define a floor scoop 240. The floor scoop 240 can be removable from the body 232. Furthermore, the height of the floor scoop 240 may be changed as needed. An intake port 244 can be integrally formed or otherwise coupled to the body 232. In one mode of operation, the wet/dry vacuum 230 can vacuum directly through a hose 248, via the intake port 244, and/or the wet/dry vacuum 230 may vacuum directly through the floor scoop 240. In one example, the wet/dry vacuum 230 can vacuum through the floor scoop 240 via the intake port 244 (such as described above) or alternatively, the floor scoop 240 can vacuum directly into the body 232 by way of a secondary intake port 250 as will be described in relation to FIG. 18.

Figure 18:
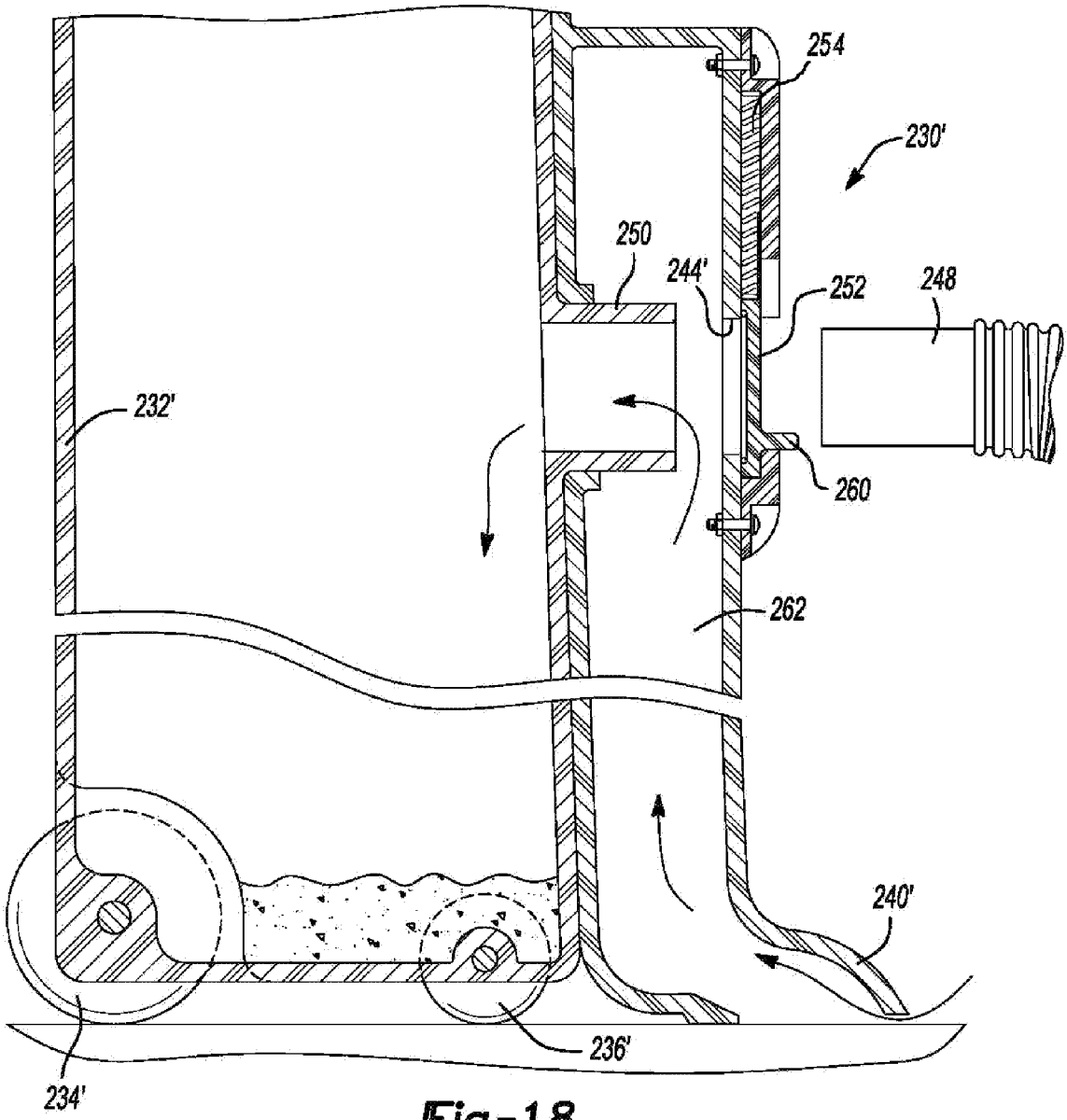
FIG. 18 is a cross-sectional view of an exemplary wet/dry vacuum constructed in accordance to additional features of the present disclosure.

As shown in FIG. 18, a wet/dry vacuum 230' can define an access door 252 that may open and/or close automatically. The access door 252 can be biased into a closed position by a biasing member 254. The access door 252 may be opened manually, or automatically, for example when contacted by a hose 248 or by lifting an access finger 260. When the access door is open, the hose 248 can couple to the secondary port 250. When the hose 248 is removed, the vacuum action is directed to the floor scoop 240' through an access duct 262. Other configurations for the access door are contemplated such as a pivoting or rotation access door for example.

Figure 20:
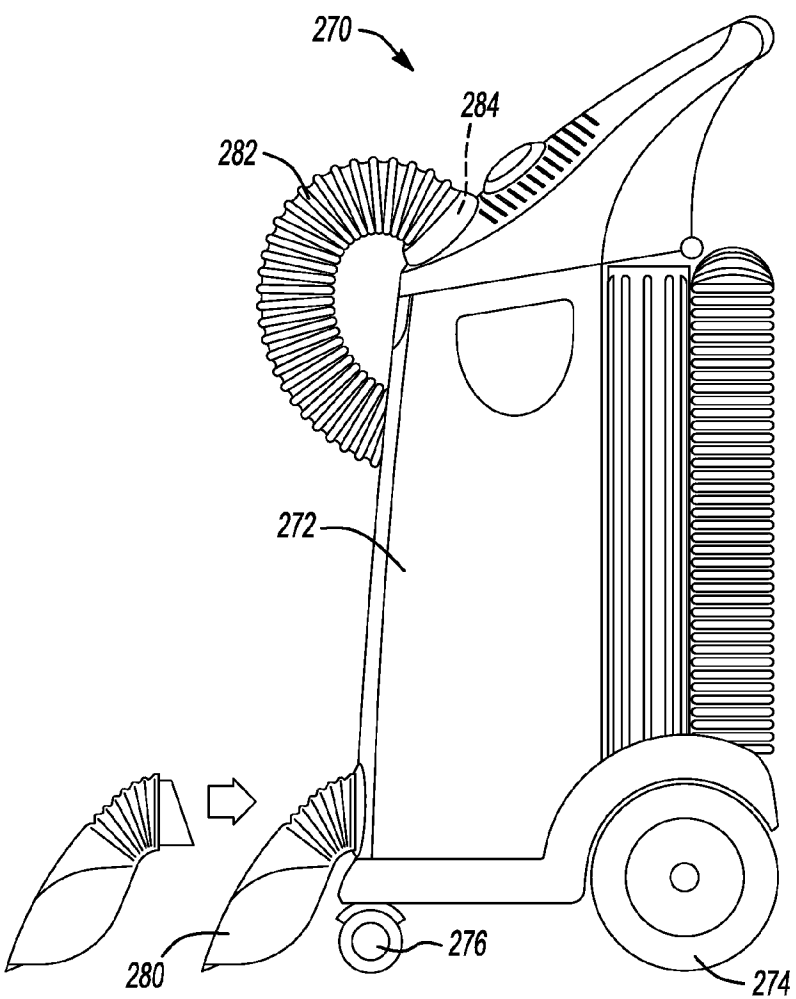
FIG. 20 is a side view of the exemplary wet/dry vacuum of FIG. 19.
Figure 19:
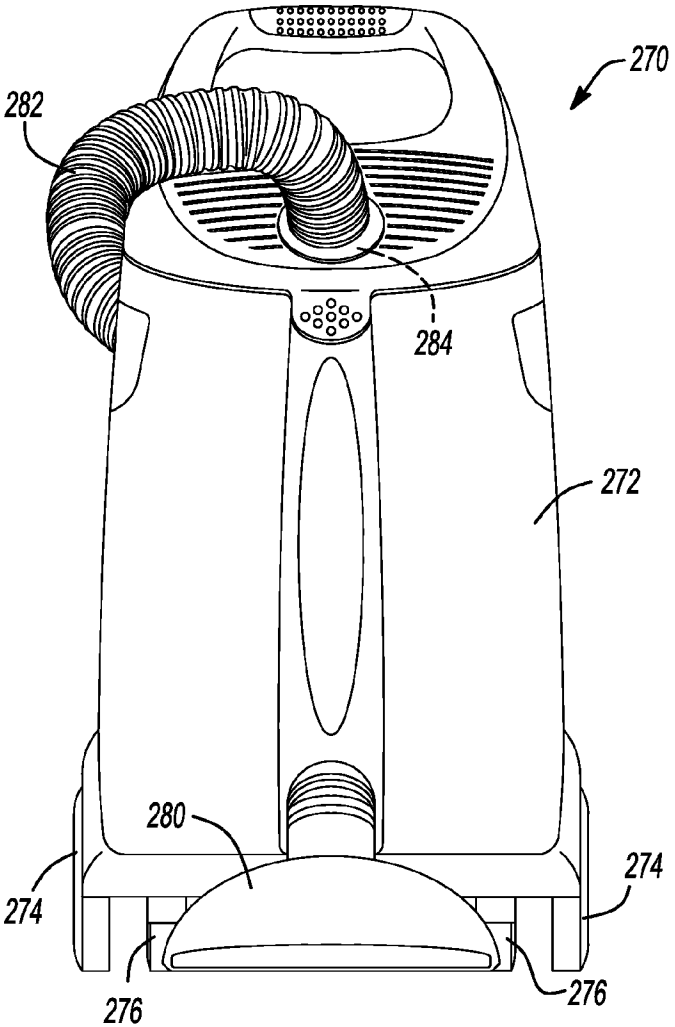
FIG. 19 is a front view of an exemplary wet/dry vacuum constructed in accordance to additional features of the present disclosure.
Figure 21:
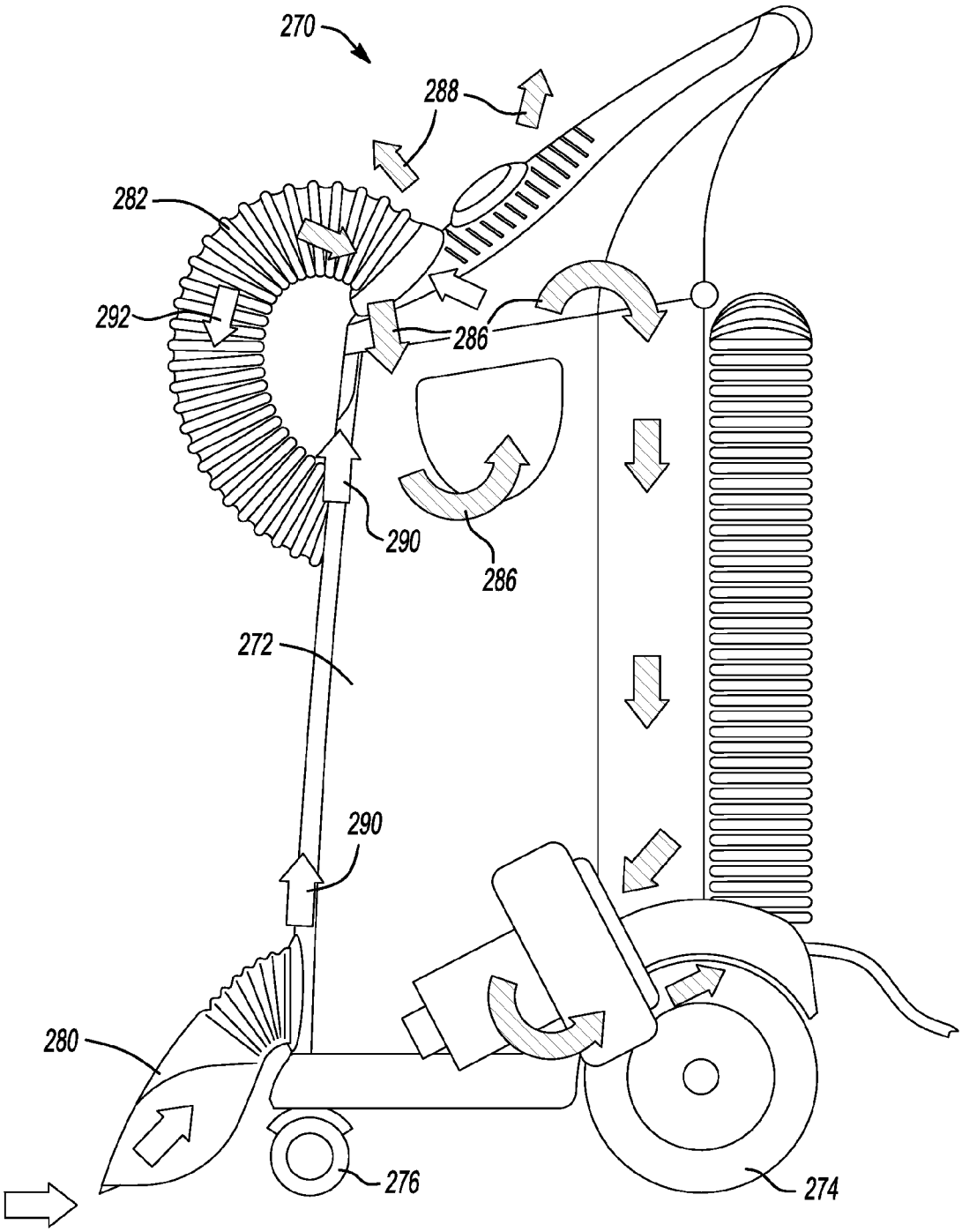
FIG. 21 illustrates exemplary flow paths through the wet/dry vacuum of FIG. 20.

Turning now to FIGS. 19-21, a wet/dry vacuum according to additional features is shown and generally identified at reference numeral 270. The wet/dry vacuum 270 can define a rectangular body 272. A first and second pair of wheels, 274 and 276, respectively, may be coupled to the vacuum 270 for rolling the vacuum 270 across a floor. The first pair of wheels 274 may be fixed for rotation about an axis. The second pair of wheels 276 can be caster wheels that rotate about axles within carriers, similar to described with wheels 50 (FIG. 1).

The wet/dry vacuum 270 can define a floor scoop 280. The floor scoop 280 can be removable from the body 272. A hose 282 can be selectively coupled to an intake port 284. FIG. 21 illustrates exemplary flow paths of the wet/dry vacuum 270. The flow paths may include, for example, a main hose path 286, a main exhaust path 288, a secondary floor scoop vacuum path 290 and/or a secondary hose blower exhaust path 292.

While the invention has been described in the specification and illustrated in the drawings with reference to various embodiments, it will be understood by those skilled in the art that various changes may be made and equivalents may be substituted for elements thereof without departing from the scope of the invention as defined in the claims. Furthermore, the mixing and matching of features, elements and/or functions between various embodiments is expressly contemplated herein so that one of ordinary skill in the art would appreciate from this disclosure that features, elements and/or functions of one embodiment may be incorporated into another embodiment as appropriate, unless described otherwise above. For example, a "blower mode" may be incorporated on any wet/dry vacuum described above such that air may be exhausted through the hose (as depicted at reference 292 in FIG. 21) Moreover, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the foregoing description and the appended claims.

What is claimed is:

1. A vacuum comprising:

a housing having an inlet adapted to receive debris being vacuumed;

a mounting member fixedly coupled to the housing;

a floor collector assembly rotatably disposed about a first axis defined by the mounting member, the floor collector assembly including a connecting duct and a floor scoop that defines an opening; and wherein the floor scoop rotates relative to the connecting duct about a second axis between a first position and a second position, wherein the opening is at a first orientation relative to a vacuumed surface in the first position and at a second orientation relative to the vacuumed surface in the second position, wherein the first orientation is distinct from the second orientation and wherein the first axis intersects the second axis.

2. The vacuum of claim 1 wherein the opening defines a plane that is substantially perpendicular to the vacuumed surface in the first position and defines an acute angle relative to the vacuumed surface in the second position.

3. The vacuum of claim 1 wherein the mounting member comprises a tubular bar and wherein the floor collector assembly is rotatable about the tubular bar into a storage position wherein the floor collector assembly is offset from a ground surface.

4. The vacuum of claim 1 wherein one of the floor scoop or the connecting duct defines a collar and the other of the floor scoop or the connecting duct defines a bore, wherein the collar rotates within the bore about the second axis during rotation of the floor scoop between the first position and the second position.

5. The vacuum of claim 4 wherein one of the floor scoop or the connecting duct defines a hub and the other of the floor scoop or the connecting duct has a pair of fingers that define a notch, wherein the hub positively nests in the notch in the first and second positions and wherein the hub ramps out of the notch over one of the fingers upon sufficient force during movement of the floor scoop from the first or second positions.

6. The vacuum of claim 2, further comprising an attachment selectively coupled to the floor scoop in an installed position, the attachment defining a longitudinal passage that defines a substantially smaller area than the opening, wherein the longitudinal passage defines a plane that is substantially parallel to the vacuumed surface in the installed position.

7. The vacuum of claim 6 wherein the attachment includes a blade that extends through the longitudinal passage and is adapted to slidably traverse along the vacuumed surface.

8. A vacuum comprising:

a housing having an inlet adapted to receive debris being vacuumed;

a mounting bar fixedly coupled to the housing;

a floor collector assembly rotatably disposed about a first axis defined by the mounting bar, the floor collector assembly including a first debris-passing member coupled to the mounting bar, a second debris-passing member rotatably coupled to the first debris-passing member and defining an opening, and a third debris-passing member removably coupled to the second debris-passing member; and wherein the floor collector assembly is operable in a plurality of modes comprising:

a first mode wherein the opening is substantially perpendicular relative to a vacuumed surface;

a second mode wherein the second debris-passing member is rotated relative to the first debris-passing member about a second axis such that the opening is at an acute angle relative to the vacuumed surface; and a third mode wherein the third debris-passing member is coupled to the second debris-passing member wherein a passage defined through the third debris-passing member is substantially parallel to the vacuumed surface.

9. The vacuum of claim 8 wherein the first axis intersects the second axis.

10. The vacuum of claim 9 wherein the first axis is substantially perpendicular to the second axis.

11. The vacuum of claim 8 wherein one of the first or second debris-passing members defines a collar and the other of the first or second debris-passing members defines a bore, wherein the collar rotates within the bore about the second axis during rotation of the second debris-passing member relative to the first debris-passing member.

12. The vacuum of claim 11 wherein one of the first or second debris-passing members defines a hub and the other of the first or second debris-passing members has a pair of fingers that define a notch, wherein the hub positively nests in the notch in a first position at the first mode and wherein the hub ramps out of the notch over one of the fingers upon sufficient force during movement of the second debris-passing member out of the first position.

13. The vacuum of claim 8 wherein the first debris-passing member defines opposing clam-shell portions that cooperate to form a first and a second pair of opposing planar sides.

14. The vacuum of claim 13 wherein the second debris-passing member defines a back surface and a first pair of opposing surfaces, wherein one surface of the first pair of opposing surfaces is larger than the corresponding opposing surface of the first pair such that the opening defines an acute angle relative to the back surface.

15. The vacuum of claim 14 wherein the back surface opposes the first debris-passing member.

16. A vacuum comprising:

a housing having an inlet adapted to receive debris being vacuumed;

a mounting bar coupled to the housing;

a floor collector assembly rotatably disposed about a first axis defined by the mounting bar, the floor collector assembly including a first debris-passing member coupled to the mounting bar, a second debris-passing member rotatably coupled to the first debris-passing member and defining an opening, and a third debris-passing member removably coupled to the second debris-passing member; and wherein the floor collector assembly is operable in a plurality of modes comprising:

a first mode wherein the opening is at a first orientation relative to a vacuumed surface;

a second mode wherein the second debris-passing member is rotated relative to the first debris-passing member about a second axis such that the opening is at a second orientation relative to the vacuumed surface; and a third mode wherein the third debris-passing member is coupled to the second debris-passing member at the second orientation wherein a passage defined through the third debris-passing member is substantially parallel to the vacuumed surface.

17. The vacuum of claim 16 wherein the first axis is substantially perpendicular to the second axis.

18. The vacuum of claim 16 wherein one of the first or second debris-passing members defines a collar and the other of the first or second debris-passing members defines a bore, wherein the collar rotates within the bore about the second axis during rotation of the second debris-passing member relative to the first debris-passing member.

19. The vacuum of claim 16 wherein one of the first or second debris-passing members defines a hub and the other of the first or second debris-passing members has a pair of fingers that define a notch, wherein the hub positively nests in the notch in a first position at the first mode and wherein the hub ramps out of the notch over one of the fingers upon sufficient force during movement of the second debris-passing member out of the first position.

20. The vacuum of claim 16 wherein the first debris passing member defines opposing claim-shell portions that cooperate to form a first and a second pair of opposing planar sides.

21. The vacuum of claim 20 wherein the second debris-passing member defines a back surface and a first pair of opposing surfaces, wherein one surface of the first pair of opposing surfaces is larger than the corresponding opposing surface of the first pair such that the opening defines an acute angle relative to the back surface.

22. The vacuum of claim 21 wherein the back surface opposes the first debris-passing member.

23. A vacuum comprising:

a housing having an inlet adapted to receive debris being vacuumed;

a mounting bar fixedly coupled to the housing;

a floor collector assembly rotatably disposed about a first axis defined by the mounting bar, the floor collector assembly including a first debris-passing member coupled to the mounting bar, a second debris-passing member rotatably coupled to the first debris-passing member and having a substantially rectangular footprint defining an opening, and a third debris-passing member removably coupled to the second debris-passing member; and wherein the floor collector assembly is operable in a plurality of modes comprising:

a first mode wherein the opening is substantially perpendicular relative to a vacuumed surface;

a second mode wherein the second debris-passing member is rotated relative to the first debris-passing member about a second axis defined by a cooperating collar and bore formed on the first and second debris-passing members, respectively, such that the opening is at an acute angle relative to the vacuumed surface, the second axis being substantially perpendicular to the first axis; and a third mode wherein the third debris-passing member is coupled to the second debris-passing member wherein a passage defined through the third debris-passing member is substantially parallel to the vacuumed surface.

* * * * *